US008732866B2

(12) United States Patent
Genz et al.

(10) Patent No.: US 8,732,866 B2
(45) Date of Patent: May 27, 2014

(54) FABRIC CONSTRUCTIONS WITH SENSORY TRANSDUCERS

(76) Inventors: Ryan T. Genz, Stockholm, ME (US); Francesca Rosella, Rome (IT)

( * ) Notice: Subject to any disclaimer, the term of this patent is extended or adjusted under 35 U.S.C. 154(b) by 491 days.

(21) Appl. No.: 12/950,047

(22) Filed: Nov. 19, 2010

(65) Prior Publication Data

US 2011/0119812 A1 May 26, 2011

Related U.S. Application Data

(60) Provisional application No. 61/263,065, filed on Nov. 20, 2009.

(51) Int. Cl.
*A41D 27/08* (2006.01)

(52) U.S. Cl.
USPC ..... 2/244; 2/115; 362/103

(58) Field of Classification Search
USPC ..... 2/115, 69, 122, 246, 90, 244; 362/103–106
See application file for complete search history.

(56) References Cited

U.S. PATENT DOCUMENTS 4,164,008 A * 8/1979 Miller et al. ..... 362/103
4,466,136 A * 8/1984 Bottom et al. ..... 2/115
4,480,293 A * 10/1984 Wells ..... 362/108
4,570,206 A * 2/1986 Deutsch ..... 362/103
4,709,307 A * 11/1987 Branom ..... 362/103
4,727,603 A * 3/1988 Howard ..... 2/115
4,823,240 A * 4/1989 Shenker ..... 362/103
4,860,364 A * 8/1989 Giannini ..... 381/333
4,875,144 A * 10/1989 Wainwright ..... 362/103
5,111,366 A * 5/1992 Rife et al. ..... 362/605
5,113,325 A * 5/1992 Eisenbraun ..... 362/103
5,278,734 A * 1/1994 Ferber ..... 362/103
5,371,657 A * 12/1994 Wiscombe ..... 362/103
5,455,749 A * 10/1995 Ferber ..... 362/103
5,879,069 A 3/1999 Chien
6,116,745 A * 9/2000 Yei ..... 362/105
6,170,959 B1 * 1/2001 Richardson, III ..... 362/103
6,210,771 B1 * 4/2001 Post et al. ..... 428/100
6,279,170 B1 * 8/2001 Chu ..... 2/246
6,395,121 B1 * 5/2002 De Bastiani ..... 156/250
6,410,137 B1 6/2002 Bunyan
6,977,055 B2 * 12/2005 Gallant et al. ..... 264/167
RE39,387 E * 1/2007 Golle et al. ..... 2/69
7,229,183 B2 * 6/2007 Golle et al. ..... 362/108
7,506,991 B2 * 3/2009 Esses ..... 362/103

(Continued)

FOREIGN PATENT DOCUMENTS

EP 2072009 A1 6/2009

*Primary Examiner* — Richale Quinn
(74) *Attorney, Agent, or Firm* — Ladas & Parry LLP

(57) ABSTRACT

A fabric construction includes sensory transducers, such as light-emitting diodes, for sensory effects while maintaining the look and feel of a conventional fabric item. The construction is especially adapted for implementation as a garment. The construction has a fabric layer and an appliqué on a front surface of the fabric layer. A plurality of electrical sensory transducers are arranged in a desired pattern with an electrical harness electrically interconnecting the sensory transducers to a drive and control circuit. The transducers and harness are located between a rear surface of the appliqué and a front surface of the fabric layer, while the drive and control circuitry is positioned at a rear surface of the fabric layer. The fabric layer and appliqué are bonded together to seal the transducers and harness in place. Releasable connectors extend through the fabric layer to operatively connect the harness to the drive and control circuit.

14 Claims, 5 Drawing Sheets

(56) References Cited

U.S. PATENT DOCUMENTS

| | | | | |
|---|---|---|---|---|
| 7,611,255 | B1 * | 11/2009 | Lagassey | 362/103 |
| 8,116,898 | B2 * | 2/2012 | Chung et al. | 700/141 |
| 2001/0042262 | A1 * | 11/2001 | Chu | 2/246 |
| 2002/0076948 | A1 * | 6/2002 | Farrell et al. | 438/800 |
| 2002/0193018 | A1 | 12/2002 | Blanchfield et al. | |
| 2003/0213045 | A1 * | 11/2003 | Fuentes | 2/69 |
| 2004/0187184 | A1 * | 9/2004 | Rubin et al. | 2/69 |
| 2007/0056074 | A1 * | 3/2007 | Esses | 2/69 |
| 2007/0067885 | A1 * | 3/2007 | Fernandez | 2/1 |
| 2007/0279894 | A1 * | 12/2007 | Esses | 362/103 |
| 2008/0019120 | A1 * | 1/2008 | Rapisarda | 362/103 |
| 2009/0100570 | A1 * | 4/2009 | Tuan | 2/122 |
| 2009/0251077 | A1 * | 10/2009 | Wilborn et al. | 315/313 |
| 2011/0197333 | A1 * | 8/2011 | Liotta | 2/90 |
| 2011/0197334 | A1 * | 8/2011 | Liotta | 2/90 |
| 2011/0197742 | A1 * | 8/2011 | Liotta | 84/725 |
| 2011/0299715 | A1 * | 12/2011 | Kaiser | 381/388 |
| 2011/0305006 | A1 * | 12/2011 | Hehenberger | 362/103 |
| 2013/0019372 | A1 * | 1/2013 | Esses | 2/69 |

* cited by examiner

FABRIC CONSTRUCTIONS WITH SENSORY TRANSDUCERS

This application claims the benefit of Provisional Application 61/263,065 filed Nov. 20, 2009. The present invention relates to textile products, and particularly garments, and more particularly to garments having an electronic circuit to create decorative effects.

BACKGROUND OF THE INVENTION

The affixation of lights and other electronically-activated sensory transducers to fabric and apparel is well known. Lights in particular provide an element of novelty and attractiveness to the apparel. Often, the light-emitting elements project through the apparel fabric (see, for example, U.S. Pat. Nos. 5,366,780; 5,278,734). The light-emitting elements are thus exposed, and are subject to damage. In addition, they can interrupt the exterior hand and feel of the fabric. The lighting elements may be mounted to circuit boards, which may be of a flexible construction, or may be interconnected and connected to a control unit by wires or by a conductive layer applied to the fabric. Other illuminated garments utilize electro-luminescent films glued or otherwise affixed to the front of the garment.

In general, garments incorporating such circuits are difficult to launder due to the nature of the mounted components and are sensitive to the ingress of moisture during washing. The circuits themselves are also often relatively energy-intensive, requiring either large batteries or the need to frequently replace the batteries. In addition, the complexity of manufacture of the circuits and their installation upon the garment can be cost prohibitive, and can impede the range of designs in which the circuitry is employed and limit the effects able to be obtained at reasonable cost.

It is accordingly an object of the present invention to provide an item of apparel incorporating transducers, and preferably illumination means, that is both efficient to manufacture and efficient in operation.

A further object of the present invention is to provide an item of apparel having transducers, and preferably illumination means, that substantially retain the look and feel of a conventional garment and which may be laundered with limited risk of damage to the transducer circuitry.

Another object of the present invention is to provide a garment or other fabric item, and a method of assembling such a garment or fabric item that facilitates the incorporation of a variety of sensory signal generating transducers, such as illumination means, to allow for a wide variety of designs and transducer patterns.

A still further object of the present invention is to provide a fabric article construction wherein potentially replaceable or moisture-sensitive circuit components may be easily removed from the construction and reinstalled as desired.

BRIEF DESCRIPTION OF THE INVENTION

In accordance with the foregoing and other objects and purposes, a fabric item of the present invention preferably takes the form of a garment, and comprises a fabric body, which may be for example a shirt, and which may be of a chosen fabric. An overlying appliqué defines a design that incorporates means for generating the desired sensory signals, such as illumination. In the case of illumination means, the appliqué may include substantially opaque areas as well as transparent or translucent areas to be illuminated by illumination means. The sensory signal generators or transducers, such as illumination means, are positioned between the appliqué and fabric surface to which the appliqué is to be applied, and are interconnected by wires to allow them to be located in accordance with a desired pattern. The transducers and interconnecting wires are bonded to the rear surface of the appliqué. The wires may be uncoated and are threaded through receiving elements associated with the transducers to allow a single wire strand to interconnect a plurality of the transducers as appropriate. Alternatively, the wires may be in the form of flexible circuits. The appliqué is bonded to the fabric, the transducers and accompanying connection circuitry being sandwiched between the appliqué and the fabric.

The circuit wires are led to a connector, which preferably may be a series of snap eyelets, located upon the rear surface of the appliqué. The eyelets interconnect with corresponding connectors located on a control circuit board, which includes a power supply, typically in the form of one or more batteries, and which may be supported in a small pocket on the rear surface of the fabric. The control circuit board typically includes circuitry to activate the transducers in a desired pattern and sequence. The control electronics and power supply can be installed and removed as desired, either when batteries expire or when operation of the circuit is to be halted, such as when it is desired to launder the garment.

BRIEF DESCRIPTION OF THE DRAWINGS

A fuller understanding of the present invention will be obtained upon consideration of the following detailed description of an illustrative embodiment of the invention, when reviewed in connection with the annexed drawings wherein.

DETAILED DESCRIPTION OF THE INVENTION

Figure 1:
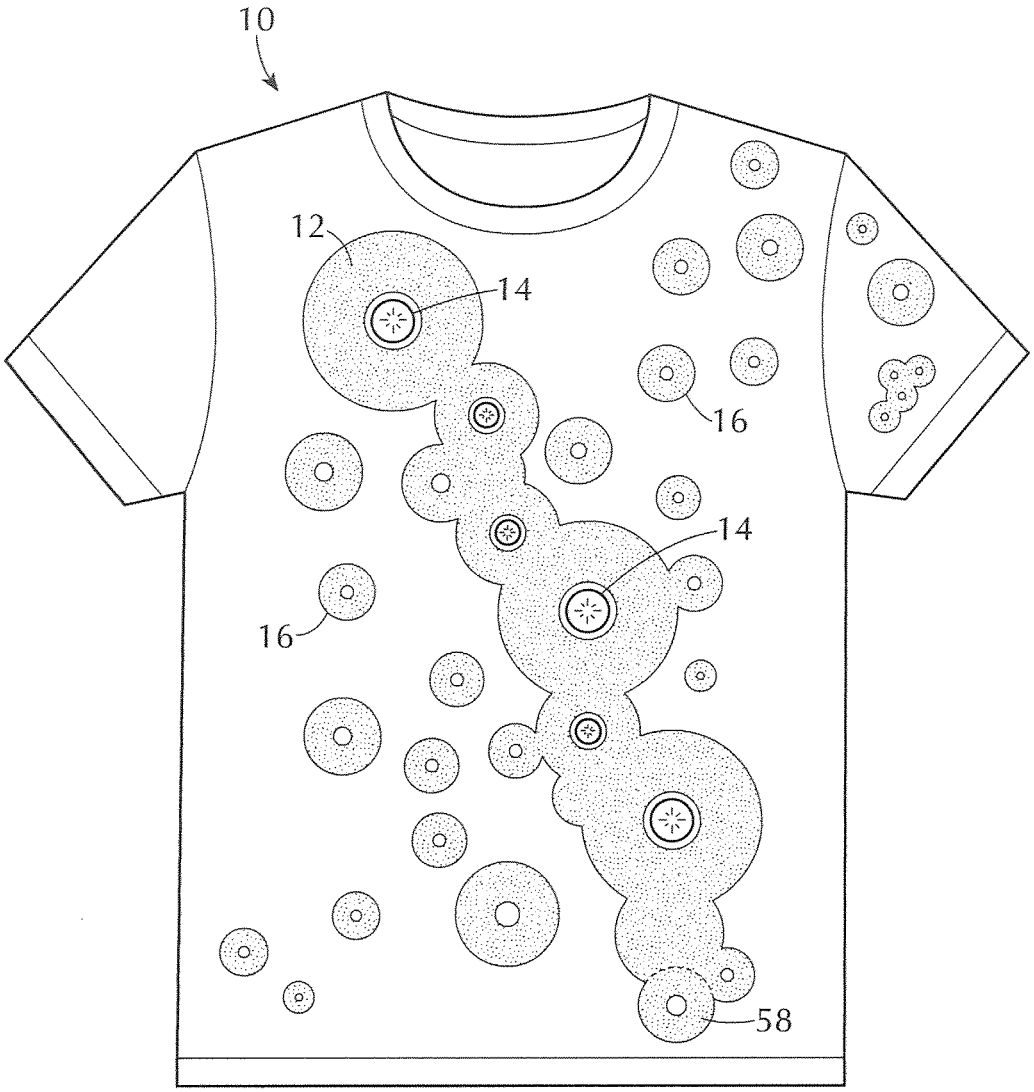
FIG. 1 is a plan view of the invention as embodied in a shirt with illumination.

As seen in FIG. 1, a fabric item with which the present invention can be employed is garment 10 in the form of a shirt. The shirt may be constructed in any desired manner, of any fabric. Located on the front of the shirt sat least one appliqué 12 which may be of any shape and design appropriate to the theme to be expressed thereby, and to which one or more sensory transducers are associated. The appliqué material may be, for example, of a microfiber fabric printed with a desired design. It also may be formed of several portions of different material, such a suede and microfiber, sewn or otherwise joined together or overlaid upon each other to provide a desired effect. Preferably, when the transducers to be used are illumination means, the appliqué can include one or more areas 14 through which it is desired that the illumination can project and be seen, as the illumination means, such as light emitting diodes (LEDs), are positioned behind the appliqué. In contrast to other portions of the appliqué, the areas 14 may be left unprinted, whereby the illumination easily passes through and illuminates the fabric, and can be observed when the shirt is worn, or the areas 14 may be printed with a transparent ink or otherwise decorated in a manner that allows the illumination to be perceived from the shirt exterior. Other decorative items, such as elements 16, may likewise be affixed to the garment exterior to augment or complete the desired design. Further, both the appliqué and other portions of the garment may receive and support further embellishments, such as sequins, crystals, textured materials and the like, allowing the garment designer to fully express his or her creative talents and fully incorporate the appliqué into the overall fabric design.

Figure 3:
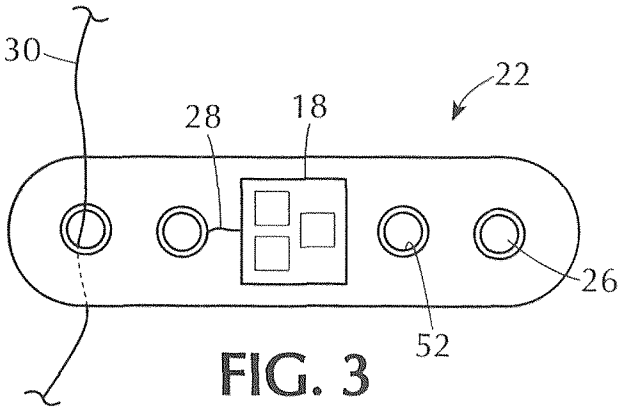
FIG. 3 is a plan view of a pad for supporting an illumination means in the form of a multi-color LED.

With further reference to FIGS. 3, 4, 6A and 6B, the sensory transducers may be in the form of illumination means in the form of compact LEDs 18 and 20. The LEDs may be, as known in the art, either capable of emitting multiple colors (18) or a single color (20). Each LED is mounted to a small non-conducting pad 22 or 24, preferably of FR4 fiberglass laminate with a thickness of 0.4 mm. As shown in FIG. 3, a preferred shape for a pad supporting a multi-colored LED is elongated or rectangular. The dimensions of the pad may be on the order of 0.45 inch by 0.162 inch, with the LED 18 or 20 centrally mounted. A series of apertures 26 are provided in the pad, through which interconnecting wires for the operating circuitry are led and to which the leads of the transducer are directed. The apertures are provided with a conductive lining 52, which may be in the form of a plated-through conductive metallic coatings or a grommet mounted in the aperture. The leads of the LED (a representative one 28 being shown in FIGS. 3 and 4) are led to and soldered to the grommets. The wires passing through the apertures are likewise soldered to the grommets to interconnect with the corresponding transducer lead. As depicted, pad 22 has four apertures, each accommodating a lead of the multi-color LED, and allowing four wires to pass through and be connect to the LED. In a likewise manner, pad 24 in FIG. 4 centrally supports single color LED 20 and is in a generally cruciform shape with a grommeted aperture 26 located on each arm. The overall length and width of the pad may be on the order of 0.262 inch. Interconnecting wires 30 are connected to the grommets, such as being woven through the apertures and being soldered to the grommets and the leads 28 from the LED, likewise connected to the grommets as appropriate. A pair of orientation indicia, such as inked lines 54, may be provided to identify the lead orientation of the mounted transducer. An LED lead may be connected to more than one grommet. Depending on the complexity of the circuitry, the lead configuration of the sensory transducer mounted to a pad and the interconnections desired to be obtained, the pads may have more or less apertures. The pads and apertures also serve as guides and spacers for the wires, and depending on the connections between a transducer's leads and the aperture grommets, wires may be woven through the apertures without an interconnection with a transducer being made. It is to be appreciated that the apertures allow a single wire of extended length to be used to interconnect a plurality of pads and transducers, rather than requiring separate wires between pads that must spliced together to form an extended length wire run. It is also to be appreciated that the pads need not support a transducer. Depending on the nature of the employed circuitry, other circuit components may likewise be mounted on a pad and interconnected to the passing wires. Further, a pad may be used solely for wire support and direction, and need not bear any electrical component. The transducers may be provided with a silicone or like coating to further protect them from environmental effects, such as moisture when the finished fabric construction is laundered.

Figure 6B:
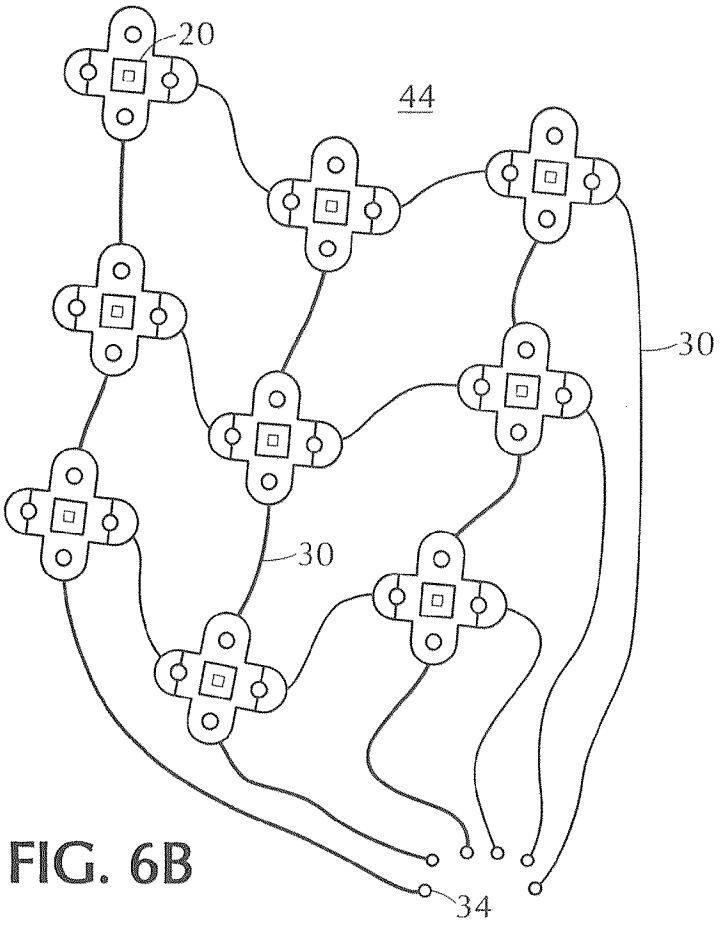
FIGS. 6A & B are illustrative diagrammatic wiring patterns for a plurality of illumination means.
Figure 6A:
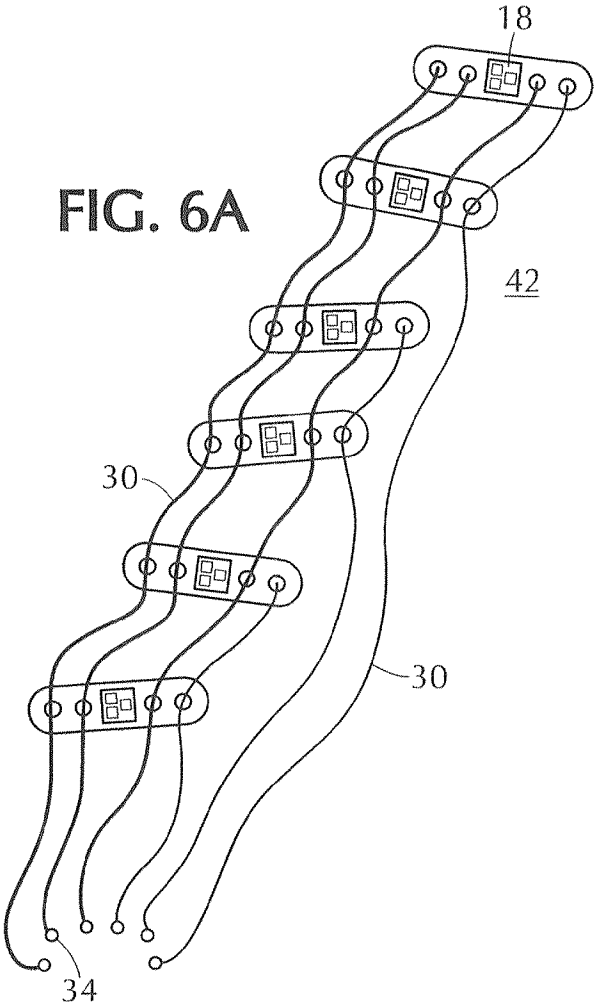

A further understanding of the wiring may be appreciated with consideration of FIGS. 6A and 6B. FIG. 6A depicts the interconnection of a plurality of multi-color LED supporting pads 22 into a harness assembly 42. As shown therein, the pads are interconnected by the wires 30. Six wires are depicted, which run between various of the pads as appropriate for the lighting pattern desired. The wires may be uninsulated, and are of relatively high flexibility and small diameter and with high strength. The wires may be of the type having a plurality of synthetic polymer fibers, each coated with an appropriate electrical conductor layer, preferably silver or another metal or alloy that is non-allergenic. An appropriate wire is that sold under the trademark AMBERSTRAND by Syscom Advanced Materials, Inc. An appropriate wire consists of 66 coated fibers, yielding a wire diameter comparable to a common sewing thread. Alternatively, the wires may be in the form of a flexible circuit, as known in the art, in which thin conductor traces are bonded to an appropriate dielectric film. Flexible circuits are available with one or more traces. The number of traces on a particular length of flexible circuit used in the present invention can be chosen in accordance with the layout and arrangement of the transducers and the desired interconnections between them.

The wires may be "woven" through the apertures of a pad as desired and required, and soldered to the aperture grommets. Depending on the desired connection and exposure of wire at the pad, a wire can be led either over the top of the pad or the bottom of the pad to avoid, particularly in the case of the cruciform pad 24, interference with the mounted transducer. The pads are positioned along the lengths of the leads as appropriate to allow the pads and LEDs to align with the desired location on the appliqué. While a wire passing through an aperture typically has a transducer lead associated with the grommet, such is not necessary, and the lead can pass through and be soldered to an aperture solely to provide a measure of alignment for the wire. If flexible circuits are used to interconnect the transducers, the grommets can be soldered to the appropriate trace. The traces of a flexible circuit can be broken at desired locations to isolate trace portions as may be appropriate for the wiring pattern required. Alternatively, the transducer leads can be mounted directly to the flexible circuit, obviating the need for a supporting pad 22.

FIG. 6B shows an illustrative harness assembly 44 with a wiring pattern incorporating the cruciform LED pads 24. As depicted therein, it can be appreciated that, as the LED 28 has two leads, each lead may be connected to either one, or two opposed, aperture grommets facilitating parallel combinations of transducers to be wired. The orientation of the pads and the interconnection thereof is dependent upon the ultimate design desired. When flexible circuits are employed and the transducers are mounted directly to the flex circuit, the harness pattern is obviously formed from the arrangement of flexible circuits, without pads.

Figure 5:
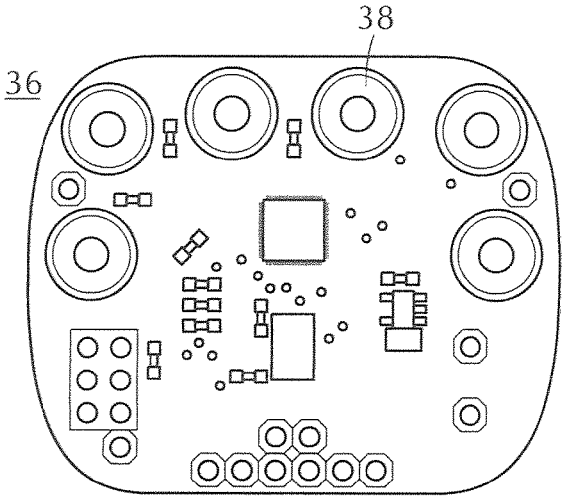
FIG. 5 is a bottom plan view of a circuit board for use in the invention.

As further depicted in FIGS. 6A and 6B, the wires of the wiring harness patterns collectively terminate at 34, allowing the wires to be connected to appropriate drive and control circuitry, as depicted generally by circuit board assembly 36 of FIG. 5. As known in the art, the circuit board may have circuitry to drive the transducers and have them operated in a desired pattern, and may for, example, include a microcomputer, along with a battery power source. To interconnect the wires with the circuit board assembly, the wires 30 are each provided with a connector 38 that mates with a complementary connector of the circuit board assembly 36. Construction of the connector 38 is discussed infra.

Figure 2:
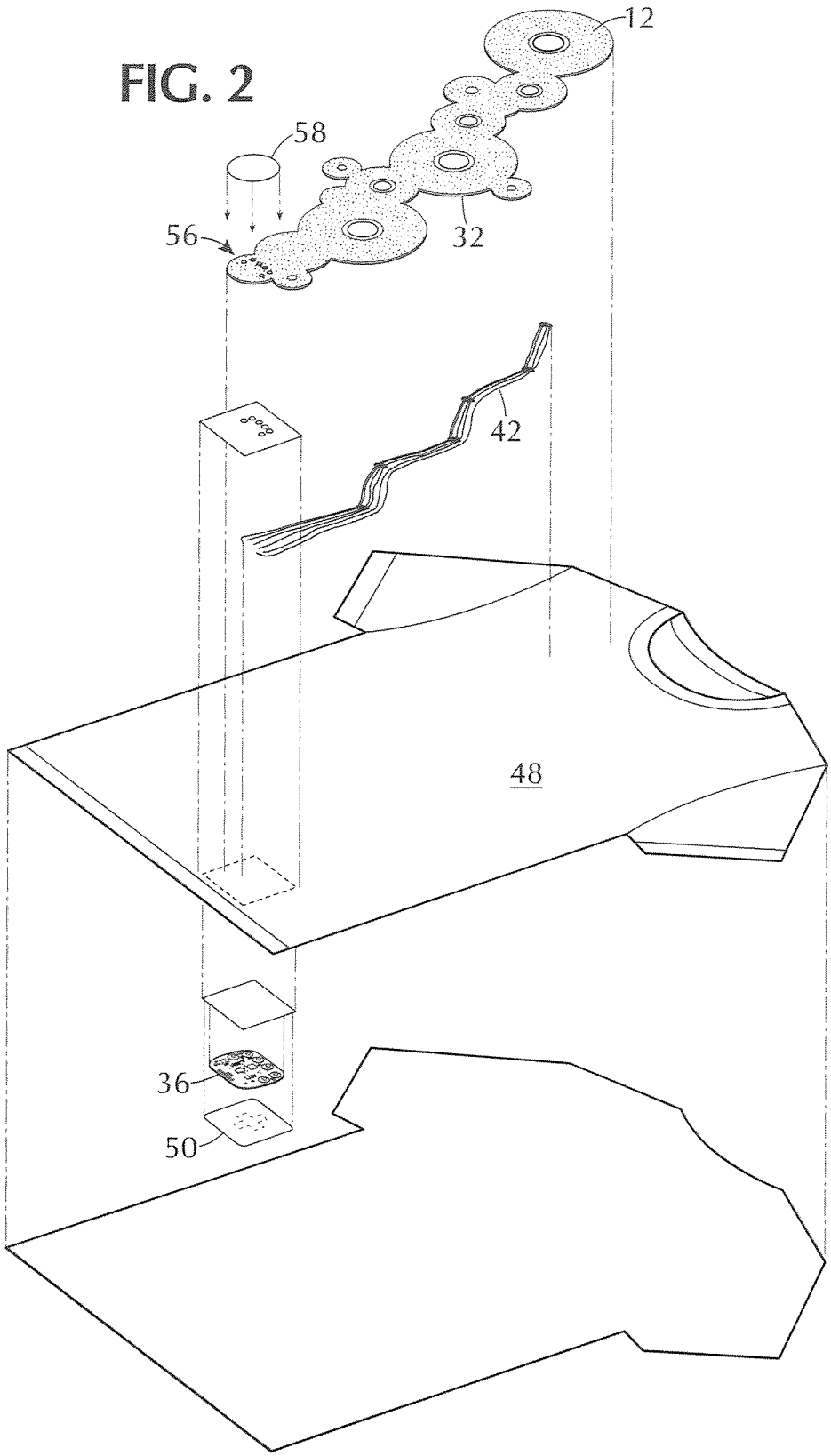
FIG. 2 is an exploded view thereof.
Figure 4:
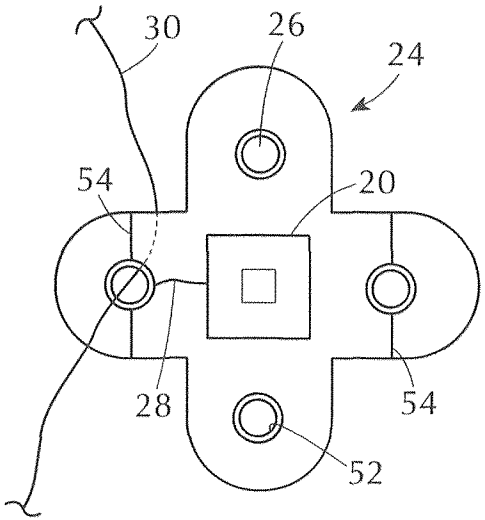
FIG. 4 is a plan view of a pad for supporting an illumination means in the form of a single color LED.

After the desired circuit is laid out and constructed, the harness assembly is placed on the bottom surface of the appliqué. The appliqué 12 has a bottom sealing layer 32, which may be waterproof, preferably of film polyurethane, such as manufactured by Framis Italia S.p.A., Gaggiano, Italy. With the appliqué inverted, such that the sealing layer is face up, the wiring harness is placed on the film layer in the desired orientation. The polyurethane sealing layer film has a slight tack, so that it gently adheres to the appliqué, maintaining its orientation, and also allow the harness placed on the film to be retained in the proper orientation. As seen in FIG. 2, the appliqué has a series of apertures 56, corresponding in number to the number of wire leads in the harness. The harness is placed on the appliqué with the wires aligned with the holes and the LEDs or other transducers aligned with the desired appliqué locations therefor. The shirt or other fabric item to which the appliqué and harness is to be affixed is then placed on the appliqué and harness combination. With the application of appropriate heat, as known in the art, the film layer melts, binding the appliqué to the fabric and trapping and sealing the harness therebetween. Because the wires are maintained in place by the sealing layer, shorting between the wires, even though they may be uninsulated, is avoided. Further, the sealing layer, particularly if of polyurethane film, is of such small thickness that it does not appreciably affect the softness and hand of the fabric composite.

Figure 7:
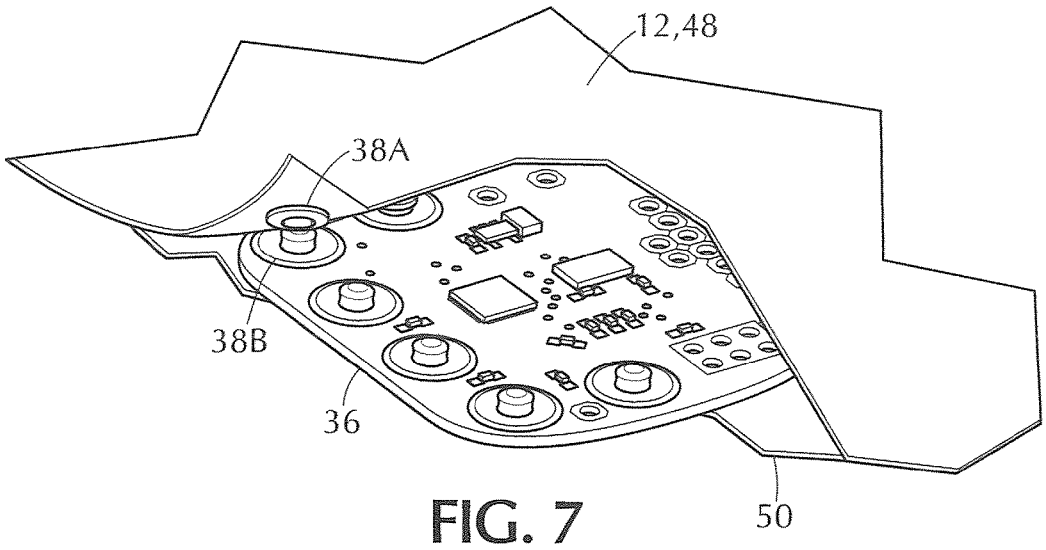
FIG. 7 is a detailed perspective view of a pocket in which the circuit board can be placed.

A series of the connectors 38 are then inserted through the appliqué apertures 56 and through the front 48 of the shirt. The connectors are preferably of the snap fit variety, each of the male 38B and female portions 38A as seen in FIG. 7 having two interconnecting elements, typically in the form of a cap and socket forming the female member and a stud and stud eyelet for the male member. The mating female members are assembled through the appliqué and shirt, trapping the wires between the two elements, establishing electrical continuity between the wires and connectors and providing for a interconnection point between the wires and control circuitry located on the inside of the shirt. If flexible circuits are used aligned holes are punched in the dielectric film to allow the connector to pass through and contact the trace. A covering piece of fabric 58 may be adhered to the appliqué to hide the tops of the connectors.

While, as discussed, the connectors are not typically affixed to the wires when the harness is initially wired, as an alternative construction the connectors may be mounted upon one or more small flexible patches, likewise positioned on the film layer with the harness, allowing the snaps to be oriented properly and maintain the orientation. The wires 30 can be soldered to the respective connectors. Such a construction can avoid the need for apertures through the appliqué.

Circuit board assembly 36 bears the needed circuitry to drive and control the transducers. As seen in FIG. 5, it includes the male portions 38B of the connectors. arranged in a pattern corresponding to the orientation of the female connectors associated with the harness wires. To support the circuit board assembly a separate piece of fabric 50 is secured to the inside surface of the shirt front, behind the exposed portions of the female snap fasteners 38A, forming a pouch or pocket for the circuit board assembly. Other supports for the circuit board, such as complementary hook-and-loop members, can also be used. As depicted in FIG. 7, the circuit board assembly 36 can be inserted within the pocket, and its snap connectors 38B aligned with and connected to the harness connectors 38A to power the circuit. The circuit board assembly can be unsnapped form the harness to allow the circuit board to be removed from the shirt pocket as needed or desired.

As the circuit board assembly is removable from the garment, and the remaining circuitry is laminated between the appliqué and fabric, the garment may be laundered with little risk to the circuitry. Further, as the mounts for the transducers are of small dimensions, they add little bulk to the garment and do not appreciably affect the overall feel and hand of the garment. And while the interconnecting wires may be uninsulated to minimize their size and maintain their flexibility, the lamination process maintains their position and provides a measure of insulation for them, avoiding unwanted contact between them. In addition, since the drive circuitry on the printed circuit assembly is removable, alternative circuit boards can be connected to the harness, providing for a variety of transducer actions.

We claim:

1. A fabric construction, comprising:

a fabric layer;

a plurality of electrical sensory transducers arranged in a desired pattern, at least two of the transducers each being mounted on a separate non-conductive pad;

a drive and control circuit for the transducers forming a module displaced from the transducers and removably located on a rear surface of the fabric layer;

an electrical harness for electrically interconnecting the sensory transducers on the separate pads;

an appliqué on a front surface of the fabric layer, the sensory transducers and electrical harness being positioned between the appliqué and the front surface of the fabric layer, the appliqué forming a non-apertured continuous covering layer for the transducers and harness and being adhered to the transducers and harness and to the front surface of the fabric layer over substantially its entire area to bond the appliqué to the fabric layer maintain the transducers and harness in a fixed position with respect to the appliqué and fabric layer; and mating releasable connection means extending through the fabric layer to operatively connect the harness to the drive and control circuit, the drive and control circuit module having one mating portion of the releasable connection means.

2. The fabric construction of claim 1, wherein the pads are provided with electrical connection means to establish contact between the sensory transducer mounted on a pad and the harness.

3. The fabric construction of claim 2 wherein the pad has apertures therethrough, the apertures having a conductive lining, the electrical transducer of the pad being electrically connected to the lining, and the harness comprises uninsulated wires led through the apertures and electrically connected thereto to establish electrical contact with the transducer of the pad.

4. The fabric construction of claim 1 wherein at least one of the sensory transducers emits light and the appliqué has at least one area aligned with and overlying the at least one sensory transducer to allow observation of the transducer's emitted light through the appliqué.

5. The fabric construction of claim 1 wherein a rear surface of the appliqué has a sealing layer upon which the transducers and harness lie.

6. The fabric construction of claim 5 wherein the sealing layer is of polyurethane.

7. The fabric construction of claim 1, wherein the harness comprises a plurality of uninsulated wires.

8. The fabric construction of claim 7, wherein the wires comprise polymer fibers with conductive coatings.

9. The fabric construction of claim 1, wherein the harness comprises flexible circuits.

10. The fabric construction of claim 1 wherein the releasable connection means comprise a electrically-conductive snap fasteners having first elements connected to the harness and mating second elements connected to the drive and control circuit.

11. The fabric construction of claim 10 wherein the drive and control circuit is located in a pocket.

12. The fabric construction of claim 1, wherein a rear surface of the appliqué has a tack to retain the transducers and harness in place.

13. The fabric construction of claim 12, wherein the rear surface has a sealing layer to adhere the appliqué to the transducers, harness and fabric layer.

14. The fabric construction of claim 13, wherein the sealing layer is heat-activated.

* * * * *